US005433383A

United States Patent [19]

Sundholm

[11] Patent Number: 5,433,383

[45] Date of Patent: Jul. 18, 1995

[54] WHIRLER NOZZLE FOR FIRE FIGHTING EQUIPMENT

[76] Inventor: Göran Sundholm, Ilmari Kiannon kuja 3, SF-04310 Tuusula, Finland

[21] Appl. No.: 255,254

[22] Filed: Jun. 7, 1994

Related U.S. Application Data

[63] Continuation of Ser. No. 946,299, filed as PCT/FI92/00156, May 20, 1992, abandoned.

[30] Foreign Application Priority Data

| | | | |
|---|---|---|---|
| May 20, 1991 | [FI] | Finland | 912434 |
| Jun. 20, 1991 | [FI] | Finland | 913059 |
| Oct. 4, 1991 | [FI] | Finland | 914704 |
| Oct. 28, 1991 | [FI] | Finland | 915078 |

[51] Int. Cl.[6] ..... B05B 1/34

[52] U.S. Cl. ..... 239/383; 239/493; 239/550

[58] Field of Search ..... 239/380, 382, 383, 493, 239/390, 472, 463, 487, 550, 222, 237, 240, 263

[56] References Cited

U.S. PATENT DOCUMENTS

| | | | |
|---|---|---|---|
| 1,395,442 | 11/1921 | MacGregor | 239/487 X |
| 1,837,339 | 12/1931 | Schlick | 239/591 X |
| 1,882,241 | 10/1932 | Curran | 239/463 |
| 4,736,801 | 4/1988 | Grewell | 239/550 X |
| 4,989,786 | 2/1991 | Kranzle et al. | 239/263 X |
| 5,332,155 | 7/1994 | Jager | 239/263 X |

FOREIGN PATENT DOCUMENTS

| | | | |
|---|---|---|---|
| 127917 | 12/1984 | European Pat. Off. | 239/383 |
| 156731 | 9/1982 | Germany | 239/463 |
| 3440901 | 7/1985 | Germany | 239/463 |
| 1666198 | 7/1991 | U.S.S.R. | 239/383 |

*Primary Examiner*—Andres Kashnikow
*Assistant Examiner*—Kevin Weldon
*Attorney, Agent, or Firm*—Ladas & Parry

[57] ABSTRACT

The object of the invention is to provide a new fire fighting equipment, which is more effective than prior art equipments. The fire fighting equipment of the invention comprises a spray head with a number of nozzles, each nozzle comprising a nozzle socket (24) with a mouthpiece (20) and a whirler (22) arranged to bear against it. The whirler (22) is supported in a housing (2) of the spray head in such a manner that the whirler is set in rotation by the liquid pressure.

7 Claims, 3 Drawing Sheets

WHIRLER NOZZLE FOR FIRE FIGHTING EQUIPMENT

This is a continuation of applications Ser. No. 07/946,299, filed on Nov. 2, 1992, now abandoned, and International Application PCT/FI92/00156, May 20, 1992.

The present invention relates to a fire fighting equipment comprising a spray head with a number of nozzles.

The object of the invention is to provide a new fire fighting equipment, which is more effective than prior art equipments.

The fire fighting equipment according to the invention is mainly characterized in that each nozzle comprises a nozzle socket fastened inside a housing of the spray head, in which socket are positioned a mouthpiece and a whirler bearing against it, which whirler together with the mouthpiece defines a whirl chamber, and that the whirler is supported in the housing in such a manner that the whirler is set in rotation by the liquid pressure.

In a preferred embodiment of the invention, the contact surface of the whirler against the mouthpiece comprises at least one oblique groove for leading liquid into the whirl chamber.

The spray head is preferably intended to be operated by a high liquid pressure of e.g. 100 bar or more, to provide a so-called fog formation. The high operating pressure sets the whirler in quick rotation, due to which the outflowing small drops are brought into strong turbulence, which results in increased extinction effect thanks to the high speed of the drops.

The whirler can preferably be supported in the housing of the spray head via a filter and an elastic sealing means positioned between the whirler and the filter.

A nozzle formed in this way can be manufactured in a length of about 10 to 12 mm, while conventional nozzles have a length of about 35 to 40 mm. A spray head of metal provided with e.g. four nozzles according to the invention has a weight of about 600 g, while a corresponding spray head provided with conventional nozzles weighs about 3 to 4 kg.

Due to the fact that the spray head can be made small in size, a suitable direction of the nozzles makes it possible to cause them to cooperate, if desired, in such a way that the fog formation areas of the individual nozzles engage with each other and intensify the fog flows as well as produce a suction providing a continuous directional fog spray with high penetrating power.

Such directional fog sprays are effective also in connection with fires considered extremely difficult to extinguish, such as fires in friteuses or in engine rooms of ships.

In the following, the invention will be described with reference to exemplifying embodiments shown schematically in the enclosed drawing.

Figure 1:
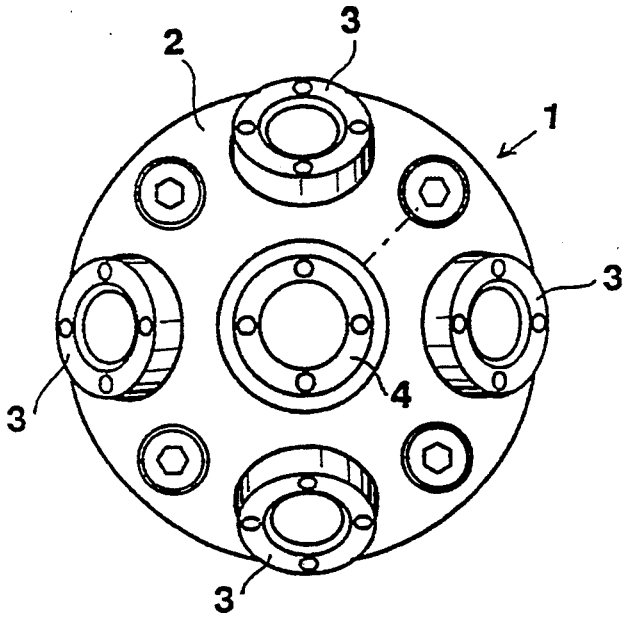
FIG. 1 is an end view of a spray head.
Figure 2:
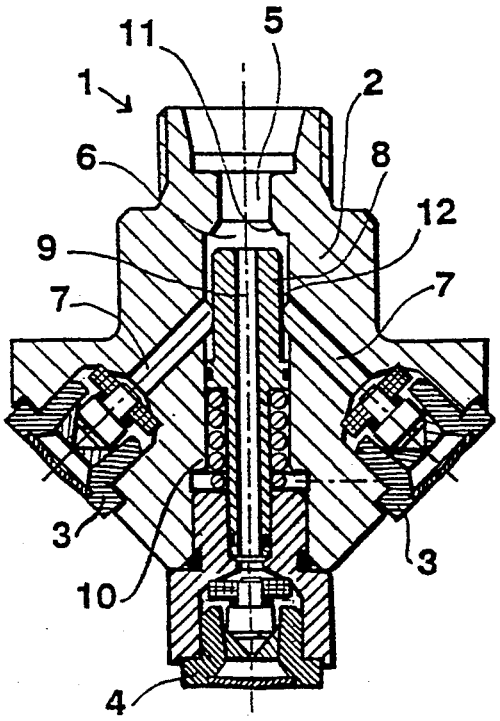
FIG. 2 shows a longitudinal section through the spray head according to FIG. 1, the spray head being activated for fire extinguishing.
Figure 3:
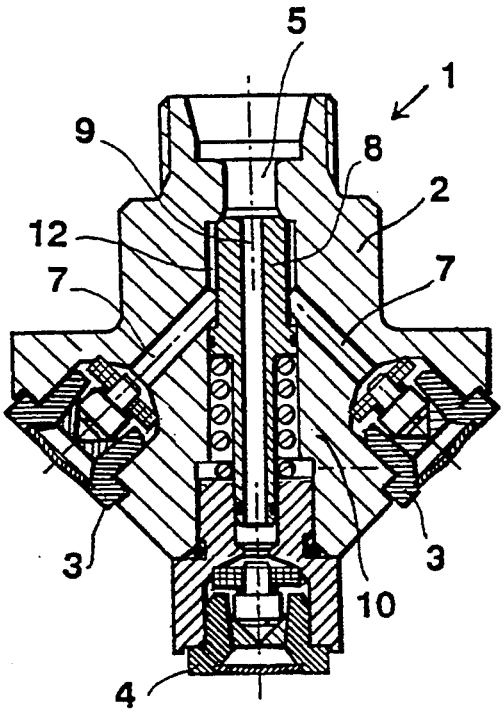
FIG. 3 shows a longitudinal section through the spray head according to FIG. 1, the spray head being activated for cooling.

In the FIGS. 1 to 3, the reference numeral 1 indicates generally a spray head. A housing or a body of the spray head 1 is indicated by 2 and four nozzles directed obliquely downwards to the side are indicated by 3.

A nozzle directed downward and positioned centrally with respect to the nozzles 3 is indicated by 4.

A liquid inlet of the spray head is indicated by 5. The inlet 5 changes into an axial boring 6 a little expanded with respect to the inlet, from which boring extend borings 7 to the side nozzles 3. In the axial boring 6 is positioned a spindle 8 with a through axial boring 9 leading to the centrally positioned nozzle 4 usually directed downwards.

A spring 10 is arranged to press the end of the spindle 8 against a shoulder 11 formed in the inlet 5.

If the pressure acting on the end of the spindle 8 via the inlet 5 overcomes the force of the spring 10, the spindle 8 takes a position according to FIG. 2. In this position, liquid can flow from the inlet 5 partially through the boring 9 of the spindle 8 to the centrally positioned nozzle 4 and partially via an annular space 12 between the spindle 8 and the wall of the boring 6 to the borings 7 extending from the boring 6 to the side nozzles 3.

If the force of the spring 10 overcomes the pressure counteracting via the inlet 5, the spindle 8 takes the position according to FIG. 3. In this position, the end of the spindle 8 is in close contact with the shoulder 11 of the inlet 5; the connection with the side nozzles 3 is closed, while the connection with the centrally positioned nozzle 4 remains.

A spray head according to the FIGS. 1 to 3 is especially suitable for being used for fire fighting in engine rooms of ships and spaces comparable with them, and thereby it is preferable to use a number of hydraulic accumulators connected in parallel as drive aggregate for extinguishing liquid.

Initially the water pressure is so high that each spindle 8 of the spray heads 1 takes a position according to FIG. 2, whereby liquid is sprayed out through all nozzles and extinguishes the fire. With the hydraulic accumulators approaching discharge, the water pressure falls in the inlet 5 of the spray heads and the spray head 8 takes the position according to FIG. 3. The rest of the water is sprayed out through each central nozzle 4 and has a function of cooling in the first place.

Figure 4:
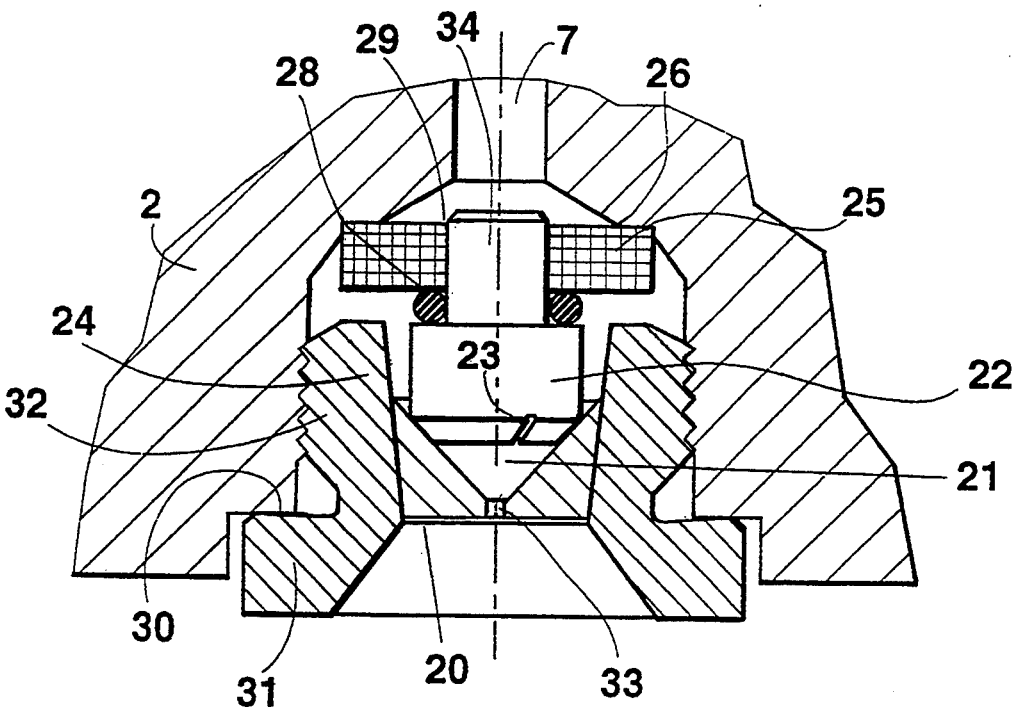
FIG. 4 shows a side sectional elevation of a preferred embodiment of a nozzle.
Figure 5:
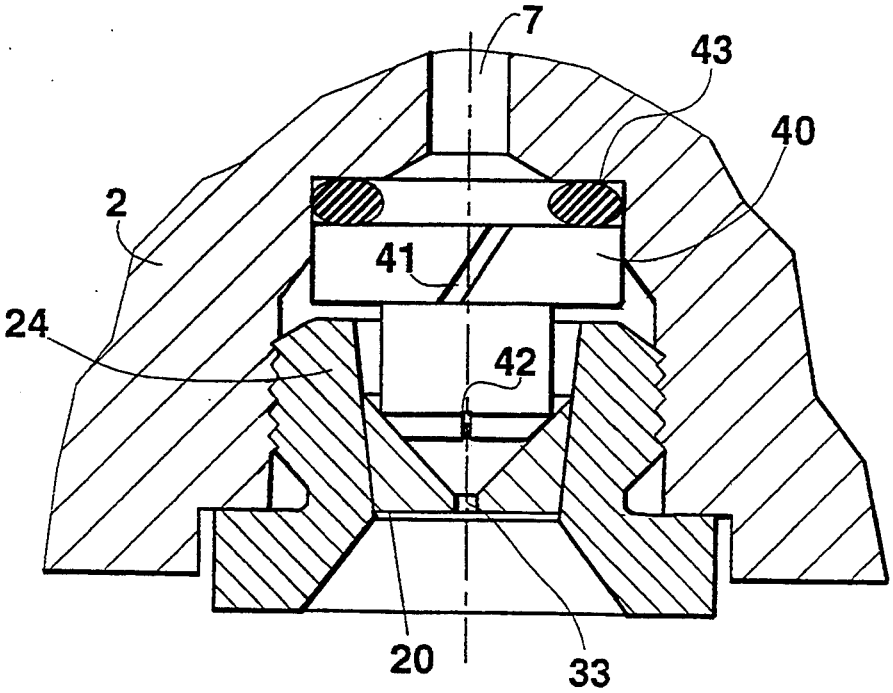
FIG. 5 shows, like FIG. 4, an alternative embodiment of a nozzle.

In FIGS. 4 and 5, the reference numeral 20 indicates a mouthpiece of the nozzle intended for spreading liquid in the form of fog-like drop formation. For this purpose, the liquid in a space 21 in front of an outlet 33 of the mouthpiece 20 must be subjected to a strong whirling motion provided by means of a whirler 22 bearing against the body of the mouthpiece 20, the contact surface of which whirler against the inner conical surface of the mouthpiece 20 in the embodiment of FIG. 4 is provided with at least one groove, suitably e.g. four preferably oblique grooves 23, for the liquid flowing in from a feed channel 7 via a disc filter 25, preferably a sintered metal filter, to an annular space between a nozzle socket 24 and the whirler 22, which groove 23 leads to the whirl chamber 21.

A nozzle seat of the housing 2 is provided with an annular shoulder 26, against which the sinter filter 25 bears thanks to the influence of the nozzle socket 24, which is fastened to the housing 2 by means of a threading 32 and presses the mouthpiece 20 against the whirler 22 and further via an elastic sealing, preferably in the form of an 0 ring 25 of a thickness of e.g. 1 mm, against the sinter filter 25 and the shoulder 26 of the housing 2.

For a satisfactory operation of the nozzle, close contact between the annular shoulder 26 of the housing 2 and the filter 25 as well as between an annular shoulder 30 of the sprinkler housing 2, the shoulder bearing against a flange 31 of the socket 24, is required; the threading 32 is not tight.

A required sealing is achieved thanks to an elastic sealing means 28, which automatically compensates for deviations in tolerance as far as the shoulders 26 and 30 with respect to the filter 25 and the flange 31 are concerned, and in addition to that, keeps the whole joint tight and enables a relatively loose, i.e. untight installation of the filter 25 on a tap 34 of the whirler 22 at 29.

Under the influence of the pressure of the driving liquid, the whirler 2 can rotate alone, together with the 0 ring 28 and even bring along the filter 25, depending on mutual friction ratios.

In the alternative embodiment of FIG. 5, the whirler is indicated by 40. Grooves 42 leading to the whirl chamber are not oblique, but on the other hand, the whirler 40 comprises a support flange, which is provided with e.g. four oblique grooves 41, by means of which the pressure of the driving liquid sets the whirler 40 in rotation. Between the support flange and the bottom of the nozzle seat is arranged an elastic sealing ring 43. The grooves 41 are deeper than the thickness of the sealing ring 43.

The whirler can also be brought into rotation in other ways within the scope of the enclosed claims.

The spray head can have four nozzles 3 directed obliquely downwards at an angle of about 45°. Especially when the individual nozzles are formed in accordance with the enclosed drawing, in which the nozzles take up relatively little space and can therefore be placed close to each other, it is possible to achieve concentration of the fog formation of the individual nozzles into a directional spray. The concentration becomes stronger when the operating pressure increases; the fog sprays turn quickly towards each other and are accompanied thereafter. The concentration effect can be secured by means of a fifth nozzle 4 directed centrally straight downwards. Achieving the desired concentration of the fog spray depends on several parameters, primarily on individual spread angles and mutual main directions of the individual nozzles; a large individual spread angle facilitates contact with the fog screen of adjacent nozzles and thus the total concentration by means of suction from outside. The resulting fog flow pattern has a resemblance to a sponge with a relatively round head. The initial drop size of the nozzles 3 can preferably be about 60 μm, while the drop size of the central nozzle 4 can be about 80 μm.

Figure 6:
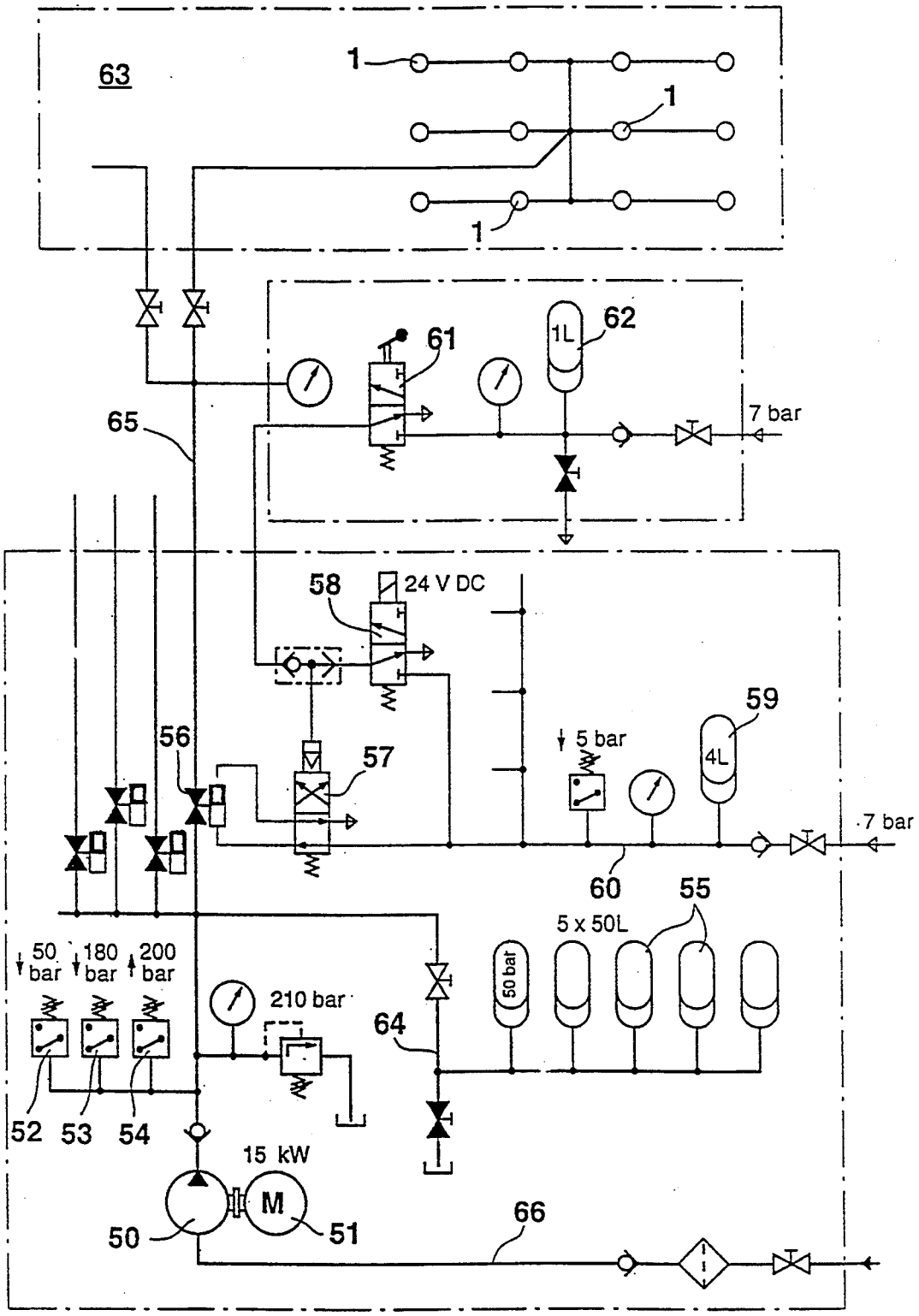
FIG. 6 shows schematically an example of an equipment in which the spray heads according to the FIGS. 1 to 3 preferably can be used.

FIG. 6 shows schematically an embodiment of an installation especially intended for fire fighting in engine rooms of ships and other such spaces.

The reference numeral 50 of the figure indicates a liquid pump, the driving motor of which is indicated by 51. Three pressure governors, preferably adjusted to react at 50 bar, 180 bar and 200 bar, respectively, are indicated by 52, 53, 54, respectively.

The numeral 55 indicates five hydraulic accumulators connected in parallel, 50 liters each with a charging pressure of about 200 bar and a discharged pressure at rest of about 50 bar. Reference numerals 56, 57, 58 and 61 indicate valves, the last mentioned of which is preferably manual. Two pneumatic accumulators with a charging pressure of e.g. 7 bar are indicated by 59 and 62, 60 indicates a line extending from the accumulator 59 to the control valves 57 and 58.

The numeral 63 indicates a fire zone, in which are placed a number of spray heads 1; the feeder from the hydraulic accumulators 55 to the fire zone 63 is indicated by 64, 65. A water pipe extending to the pump 50 is indicated by 66.

In the rest state of the equipment, the hydraulic accumulators 55 are charged up to 200 bar and the pump 50 and the motor 51 are each out of function. The valves 56 are closed, the pneumatic accumulators 59 and 62 are charged up to 7 bar and the valves 57 an 58 are currentless. The valves 61 are unactivated.

In case of a fire alarm, an electric signal is produced at the fire centre, which in a ship usually is situated on the bridge, to the valve 58, due to which the valve spindle is displaced and the valve leads pressure to a precontrol part of the valve 57, which part moves the spindle to the opposite end position. The valve 57 leads the pressure to the opposite area of a torsional cylinder of the valve 56 and the cylinder moves to the other end position. The valve 56, such as a ball valve, is now open and water flows to the spray heads 1.

After the pressure of the hydraulic accumulators 55 has fallen to 50 bar, the pressure governor 52 produces a signal to the valve 58, which becomes currentless and is moved to the basic position, and also the valve 57 is moved to the basic position and the valves 56 are closed. The pump 50 and the motor 51 have both received a starting signal at 180 bar from the pressure governor 53 and charge the hydraulic accumulators 55 up to 200 bar, after which the pump is stopped by the pressure governor 54. In the embodiment according to FIG. 4 the pump 50 can have a volume flow of about 35 liters per minute and the motor 51 a power of 15 kW. The charging time of the hydraulic accumulators 55 will be about 5 minutes, after which the equipment is ready to repeat the same procedure.

The manual valve 61 operates in the same way as the valve 58, except that water flows into the system as long as the valve 61 is kept activated. After the pressure has fallen, the valve shall be closed for a recharge of the accumulators 55.

The pneumatic accumulators 59 and 62 are kept charged by a compressed-air system.

In the embodiment shown in the drawing, in the individual spray heads the force of the spring 10 acting on the spindle 8 is fitted preferably in such a manner that the spindle 8 within the range of pressure of 200 bar to about 70 bar takes the position according to FIG. 2 and within the range of pressure of about 70 bar to 50 bar takes the position according to FIG. 3. Between 200 bar and 70 bar, the volume flow of typically 6,5 liters per minute on an average can be obtained, and between 70 bar and 50 bar, a flow of about 2 liters per minute.

By means of five hydraulic accumulators with a nominal volume of 50 liters each, an initial charging pressure of 50 bar and maximum working pressure of 200 bar, a water volume of about 190 liters is available.

An equipment like this provided with a suitable number of spray heads one can, without difficulties, meet a demand for water of about 120 liters in approximately 10 seconds within the pressure area of 200 to 70 bar, and after that, a demand for water of about 70 liters in approximately 25 seconds within the pressure area of 70 to 50 bar, thus in total 190 liters within 35 seconds.

I claim:

1. A combination of a nozzle and a spray head, the spray head comprising a housing (2), and the nozzle comprising:

a nozzle socket (24) fastened in the housing (2);

a mouthpiece (20) in the nozzle socket;

a whirler (22) in the nozzle socket between the housing and the mouthpiece, the whirler having at least one oblique peripheral groove for passing a liquid from the housing to a whirl chamber (21) defined by the whirler and the mouthpiece to set the whirler in rotation and an entrance portion supported against the housing for keeping the whirler at least essentially in contact with the mouthpiece.

2. A nozzle according to claim 1, wherein said whirler has no other liquid passage for passing the liquid in parallel with said at least one oblique peripheral groove.

3. A nozzle according to claim 1, wherein the entrance portion of said whirler is supported against the housing of the spray head via an elastic sealing means.

4. A nozzle according to claim 1, wherein the entrance portion of said whirler is supported against the housing of the spray head via an elastic sealing means and a filter, said elastic means and said filter being positioned around a pin of the whirler.

5. A nozzle according to claim 2, wherein the entrance portion of said whirler is supported against the housing of the spray head via an elastic sealing means.

6. A nozzle according to claim 1, wherein the entrance portion of said whirler is supported against the housing of the spray head via an elastic sealing means and a filter, said elastic sealing means and said filter being positioned around a pin of the whirler.

7. A nozzle for use in a spray head housing, the nozzle comprising:

a nozzle socket for fastening in a spray head housing that supplies a liquid;

a mouthpiece in the nozzle socket and having an outlet for the liquid; and a whirler in the nozzle socket, the whirler having a first surface for being supported by the spray head housing and defining thereat an entrance portion for the liquid, an opposite second surface for being supported by the mouthpiece and defining thereat a whirl chamber, and liquid passing means for passing the liquid past the whirler from the entrance portion to the whirl chamber, the liquid passing means comprising at least one oblique peripheral groove in the whirler for rotating the whirler with the passing of the liquid.

* * * * *